US005349703A

United States Patent [19]

Mocilnikar et al.

[11] Patent Number: 5,349,703

[45] Date of Patent: Sep. 27, 1994

[54] TOILET LID FOR FLUSHING A TOILET

[76] Inventors: Gabriel C. Mocilnikar, 3437 Calle La Veta, San Clemente, Calif. 92672; Roger Edwards, 15502 Pelican La., Huntington Beach, Calif. 92649; James Tipton, 26586 Paseo Carmel, San Juan Capistrano, all of Calif. 92675

[21] Appl. No.: 131,694

[22] Filed: Oct. 5, 1993

[51] Int. Cl.[5] ..... E03D 5/04

[52] U.S. Cl. ..... 4/250; 4/249; 4/408; 4/405

[58] Field of Search ..... 4/249, 250, 408, 409, 4/234, 237, 238, 335, 338, 405

[56] References Cited

U.S. PATENT DOCUMENTS

| | | | |
|---|---|---|---|
| 657,278 | 9/1900 | Barton | 4/409 |
| 1,313,740 | 8/1919 | Sager . | |
| 2,200,687 | 5/1940 | Bercot | 4/249 |
| 2,283,678 | 5/1992 | Landis | 4/251 |
| 2,428,685 | 10/1947 | Shepard | 4/250 |
| 2,628,363 | 2/1953 | Stein . | |
| 3,780,384 | 12/1923 | Rivelle | 4/408 |
| 4,085,469 | 4/1978 | Peturrson | 4/684 |
| 5,177,818 | 1/1993 | Tsai | 4/250 |

FOREIGN PATENT DOCUMENTS

| | | | |
|---|---|---|---|
| 12683 | of 1885 | United Kingdom | 4/408 |
| 331490 | 3/1929 | United Kingdom | 4/408 |

*Primary Examiner*—Henry J. Recla

*Assistant Examiner*—Gregory Vidovich

*Attorney, Agent, or Firm*—Macro-Search Corp.

[57] ABSTRACT

A toilet lid apparatus for flushing the toilet by closing the toilet lid is provided. The apparatus includes a hinge that provides a pair of standoffs adapted for attachment to the toilet for supporting a horizontal hinge bar. The toilet lid is adapted for pivotal mounting to the hinge bar and rotates between a horizontal position for covering the toilet and a near vertical position for uncovering the toilet. The lid further includes a toothed sprocket adapted for engagement with a first sleeve that is rotatably mounted on the hinge bar and has teeth arranged annularly at one end for engaging the toothed sprocket. Rotation of the lid, and hence the toothed sprocket, drives the first sleeve in rotation therewith in one rotational direction, but not in the alternate rotational direction. The first sleeve preferably includes a first plurality of engagement fingers, and a linear actuator includes a second sleeve slidably mounted on the hinge bar that provides a plurality of second engagement fingers positioned for interlocking with the first plurality of engagement fingers. The linear actuator further includes a flexible cable interconnecting the second sleeve with a water flow control lever of the toilet. As such, as the first sleeve rotates about the hinge bar, driven by the toothed sprocket, the second sleeve is caused to slide along the hinge bar in linear motion to pull the flexible cable for actuation of the water flow control lever of the toilet.

2 Claims, 3 Drawing Sheets

TOILET LID FOR FLUSHING A TOILET

FIELD OF THE INVENTION

This invention relates generally to toilet flush actuators, and, more specifically, is directed towards a toilet lid apparatus for driving the flush actuator by moving a toilet lid from an open to a closed position.

BACKGROUND OF THE INVENTION

Toilet flushing devices that are actuated by lifting or closing a toilet lid or seat are not uncommon in the prior art. For example, U.S. Pat. No. 2,628,363 to Stein on Feb. 17, 1953 teaches such a device, as does U.S. Pat. No. 2,283,678 to Landis on May 19, 1942; U.S. Pat. No. 1,313,740 to Sager on Aug. 19, 1919; and U.K. Patent 331,490 to Henreckson on Jun. 30, 1930. Such devices typically employ a rigid lever arrangement connected between the lid or seat and the flush actuator, and are usually built into the toilet. Typically the flush actuator is designed to cooperate with the lever arrangement. For the most part, such lever arrangements cannot be easily retrofitted onto conventional toilets. Clearly this presents a problem to those people who have conventional toilets that wish to install a device that will automatically flush the toilet upon lowering of the toilet seat lid.

The above referenced Stein device, while claiming to be easily retrofitted to existing flush toilets, requires significant installation. In fact, a hole must be drilled into the bottom of the flush tank reservoir when installing such a device to allow an actuator rod to engage the flush actuator. Such holes tend to leak since they experience almost constant water pressure and lateral forces imparted by moving the lever of such a device.

A further general drawback to the prior art devices is their complexity. Such devices are complicated in design, rendering them expensive to manufacture and maintain. Moreover, many such prior art devices tend to be aesthetically unpleasant to view, employing large lever devices or floor pedals with plainly visible actuator levers. Few people would approve of having such devices in their home.

Clearly, then, there is a need for a flush actuator device that is easily installed on most conventional toilets, and can be adapted to engage the existing flush actuators thereof. Such a needed device would be relatively simple to manufacture and maintain. Further, such a needed device would be relatively visually discrete when installed on a conventional toilet. The present invention fulfills these needs and provides further related advantages.

SUMMARY OF THE INVENTION

The present invention is a toilet lid assembly for flushing the toilet by closing the toilet lid. The toilet lid assembly includes a hinge that provides a pair of standoffs adapted for attachment to the toilet for supporting a horizontal hinge bar. A lid is adapted for pivotal mounting to the hinge bar and rotates between a horizontal position for covering the toilet and a near vertical position for uncovering the toilet. The lid further includes a toothed sprocket adapted for engagement with a first sleeve that is rotatably mounted on the hinge bar and has teeth arranged annularly at one end for engaging the toothed sprocket. Rotation of the lid, and hence the toothed sprocket, drives the first sleeve in rotation therewith in one rotational direction, but not in the alternate rotational direction.

The first sleeve includes a first plurality of engagement fingers, and a linear actuator includes a second sleeve slidably mounted on the hinge bar that provides a plurality of second engagement fingers positioned for interlocking with the first plurality of engagement fingers. The linear actuator further includes a flexible cable interconnected between the second sleeve and a water flow control lever of the toilet. As such, as the first sleeve rotates about the hinge bar, driven by the toothed sprocket, the second sleeve is caused to slide along the hinge bar in linear motion to pull the flexible cable for actuation of the water flow control lever of the toilet.

The present invention is a flush actuator device that is easily installed on most conventional toilets, and can be adapted to engage the existing flush actuators thereof. The present device is relatively simple to manufacture and maintain. Further, the present invention is relatively visually discrete when installed on a conventional toilet. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
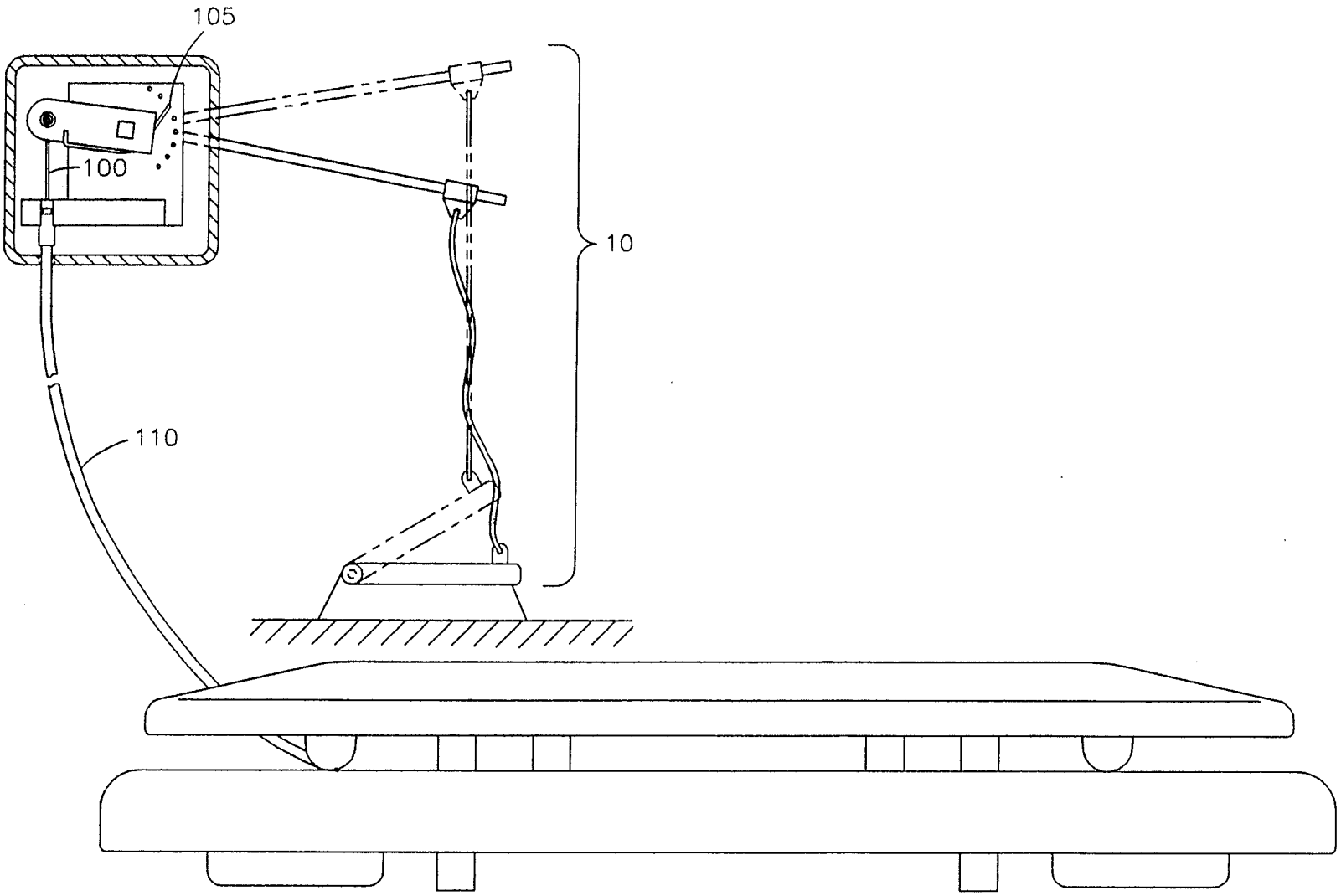
FIG. 1 is a front elevational view of the invention, illustrating a toilet seat and lid, a flexible cable means of the invention, and a water flow control means of the toilet.
Figure 2:
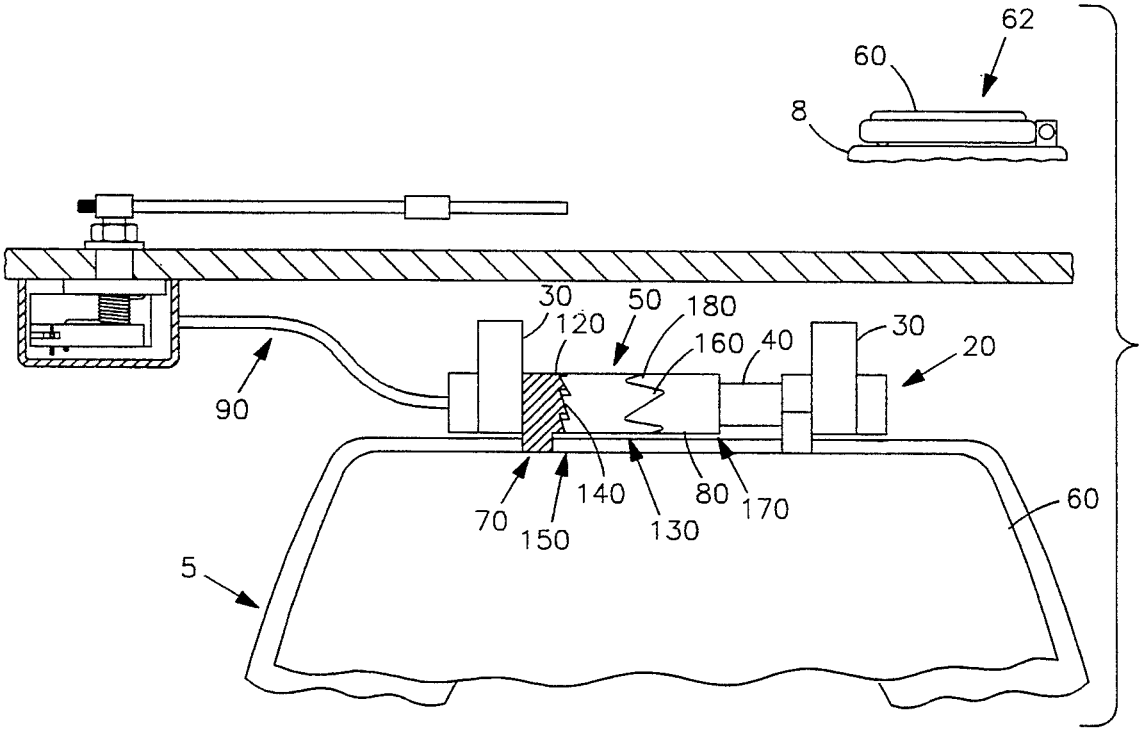
FIG. 2 is a top plan view of the invention, illustrating a lid motion actuation means and a linear actuation means of the invention, the lid of the toilet in a closed, horizontal position.
Figure 5:
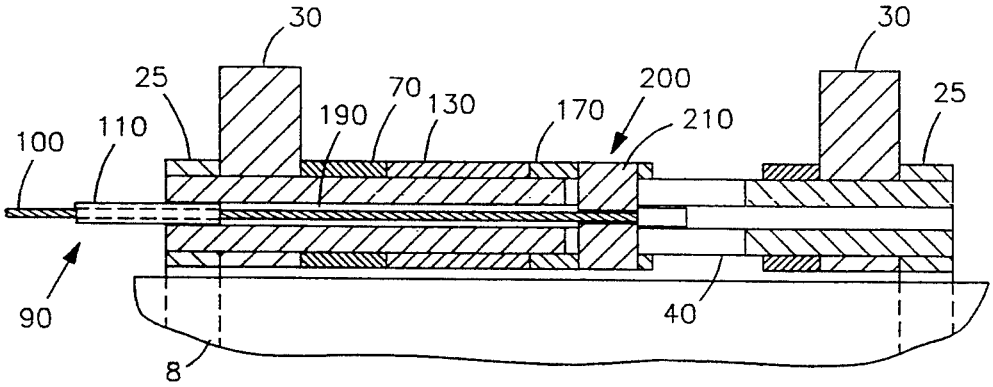
FIG. 5 is a cross sectional view of the invention, illustrating an axial channel and an engagement slot of the hinge bar.

FIGS. 1 and 2 show a toilet lid assembly 5 for a toilet 8 of the type that has a water flow control means 10 for admitting water into the toilet 8 for flushing the toilet 8. The toilet lid assembly 5 includes a hinge means 20 that provides a pair of standoffs 30 adapted for attachment to the toilet 8 for extending upwardly therefrom. A horizontal hinge bar 40 is supported between the standoffs 30, and end pieces 25 prevent the hinge bar 40 from sliding within the standoffs 30 (FIG. 5).

Figure 3:
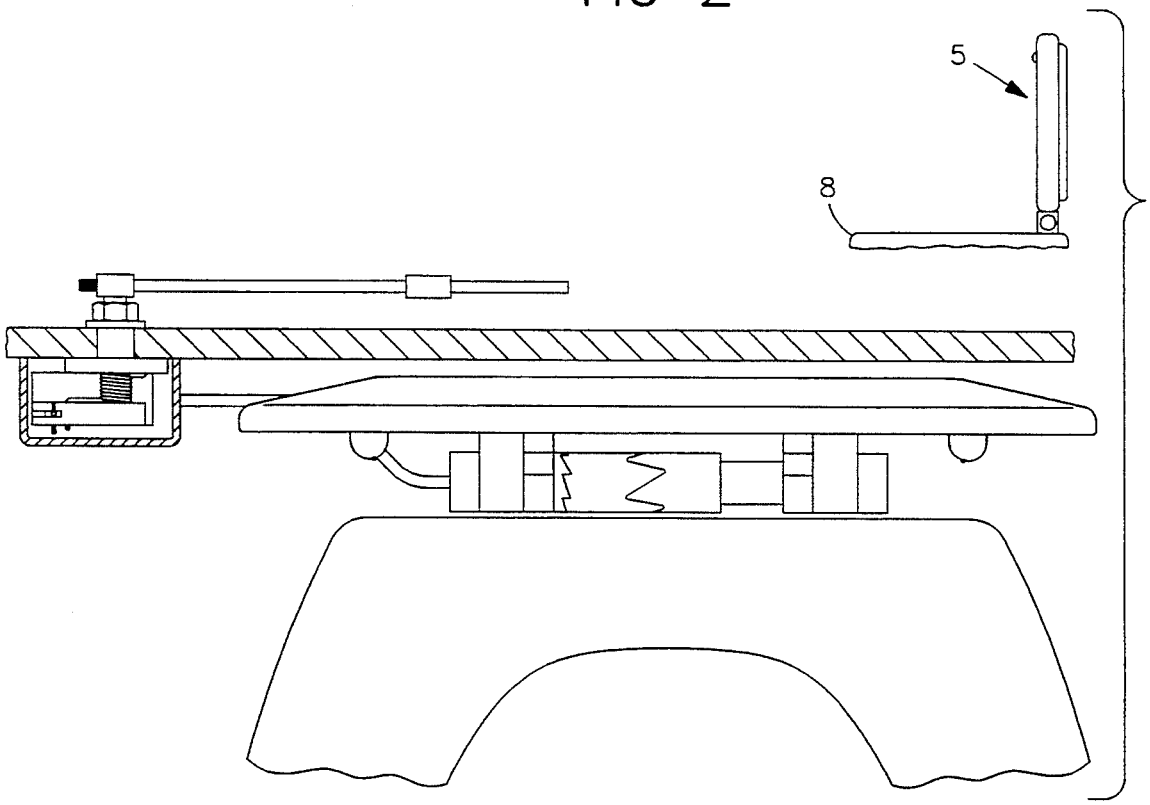
FIG. 3 is a top plan view of the invention, illustrating the lid of the toilet in an open, near vertical position.
Figure 4:
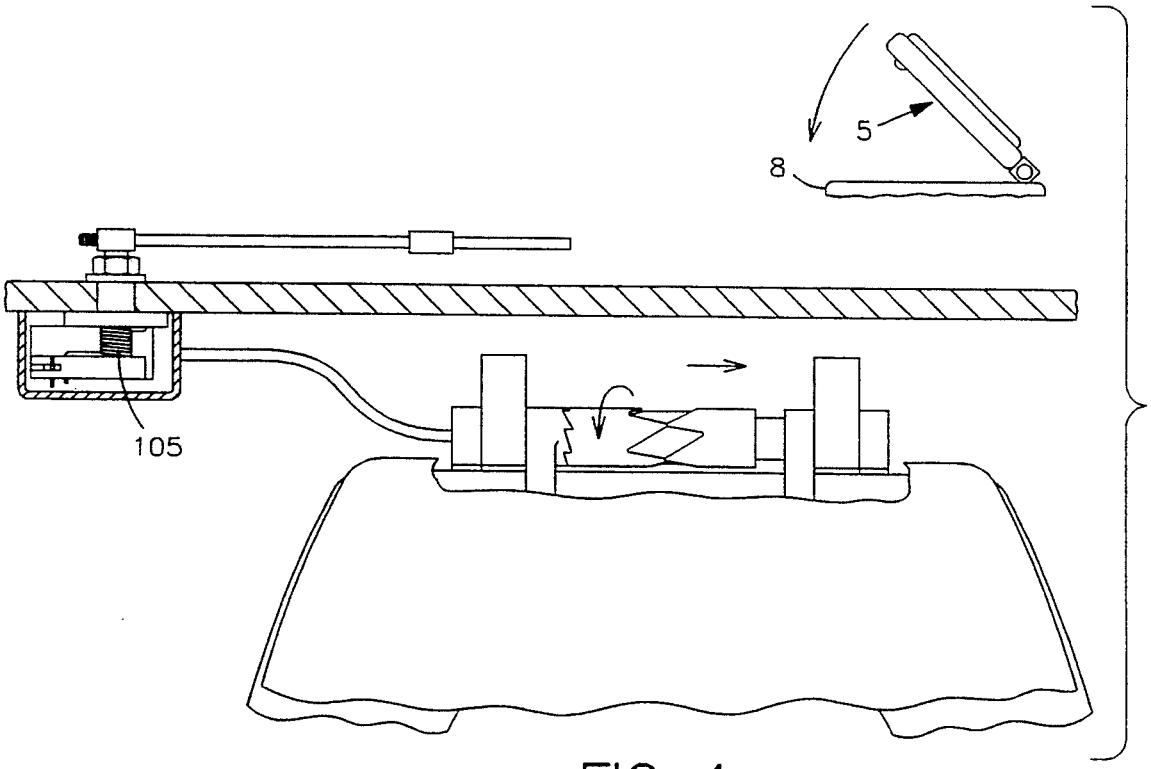
FIG. 4 is a top plan view of the invention, illustrating the lid of the toilet while being moved from the open to the closed position, and further illustrating a first sleeve, driven by a toothed sprocket, in turn driving a second sleeve in linear motion along a hinge bar of the invention.

A lid 60 is pivotally mounted to the hinge bar 40 and rotates between a horizontal position 62 (FIG. 4) for covering the toilet 8, and a near vertical position 64 (FIG. 3) for uncovering the toilet 8. The lid 60 further includes a drive means 70 adapted for engagement with a lid motion actuation means 50 of the hinge means 20. The drive means 70 of the lid 60 is preferably an annular toothed sprocket 120, and the lid motion actuation means 50 is a first sleeve 130 rotatably mounted on the hinge bar 40 and having teeth 140 arranged annularly at one end 150 thereof for engaging the toothed sprocket 120. Rotation of the toothed sprocket 120 drives the first sleeve 130 in rotation therewith in one rotational direction, but not in the alternate rotational direction. The teeth of both the toothed sprocket 120 and the first sleeve 130 are shaped so that when the lid 60 is raised, the toothed sprocket cannot rotate the first sleeve 130. Preferably the toothed sprocket 120 and the first sleeve 130 are made from a rigid, low-friction material, such as Teflon plastic.

A linear actuation means 80 includes a flexible cable means 90 interconnecting the lid motion actuation means 50 with the flow control means 10. The flexible cable means 90 is preferably of the coaxial type that has an inner movable cable 100 and an outer fixed sheath 110 (FIG. 5). The lid motion actuation means 50 further includes a first plurality of engagement fingers 160, and the linear actuation means 80 includes a second sleeve 170 slidably mounted on the hinge bar 40. The second sleeve 170 provides a plurality of second engagement fingers 180 positioned for interlocking with the first plurality of engagement fingers 160 such that as the first sleeve 130 rotates about the hinge bar 40, driven by the toothed sprocket 120, the second sleeve 170 is caused to slide along the hinge bar 40 restricted to linear motion by anchor bar 210 (FIG. 5) to pull the inner movable cable 100 for actuation of the water flow control means 10 (FIG. 5). Clearly the flexible cable means 90 may be mounted relatively easily out of plain view, such as behind the toilet 8. Further, there is no limit to the length of the cable means 90.

A spring means 105 causes the moving cable 100 to pull the linear motion actuation means 80 toward the lid motion actuation means 50. As such, the second engagement fingers 180 are caused to press firmly against the first engagement fingers 160, and the first sleeve 130 is caused to press against and fully engage the toothed sprocket 120.

In use, the rotational motion of the lid 60 is converted to linear motion which may clearly be adapted by anyone skilled in the art to actuate any of a wide variety of existing flow control means 10. As such, while the preferred mode of the invention shows the linear actuation means 80 adapted to flush a conventional flow control means 10, it is to be clearly understood that the invention is not to be limited thereto. Any flow control means 10 that is actuated upon a physical displacement can be adapted to the present invention relatively easily. Further, the present invention may be easily installed in such a way as to allow conventional manual actuation of the flow control means 10.

In the preferred mode of the invention, the hinge bar 40 provides an axial channel 190 therethrough and an engagement slot 200. The cable means 90 is conducted through the channel 190 fixed at one end thereof to an anchor bar 210 slidably fitted in the engagement slot 200 and fixed to the second sleeve 170 for linear movement therewith (FIG. 5).

In use, rotating the lid 60 from the near vertical position 64 to the horizontal position 62 causes the lid motion actuation means 50 to linearly displace the inner movable cable 100, thereby actuating the flow control means 10 for flushing the toilet 8. However, rotating the lid 60 from the horizontal position 62 to the near vertical position 64 does not linearly displace the inner movable cable 100.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A toilet lid assembly for a toilet of the type having a toilet bowl and water flow control means for admitting water into the toilet bowl for flushing the same, the toilet lid assembly comprising:

a hinge means providing a pair of standoffs adapted to be attached to the toilet bowl and extending upwardly therefrom, a horizontal hinge bar supported therebetween, and a water flow actuation means adapted to be engaged with the hinge bar and the water flow control means;

the water flow actuation means comprising a first sleeve rotatably mounted on the hinge bar having sleeve teeth arranged annually at one end thereof, a second sleeve mounted on the hinge bar and restrained for linear motion thereon, and a toothed sprocket having sprocket teeth arranged annually at one end thereof for mating with the sleeve teeth on the first sleeve in rotational engagement on the hinge bar, the sleeve teeth and the sprocket teeth shaped so that rotation of the toothed sprocket drives the first sleeve in rotation therewith in one direction only;

a lid attached to the toothed sprocket for rotation between a horizontal position for covering the toilet bowl and a near vertical position for uncovering the toilet bowl, such that as the lid is rotated from the near vertical position to the horizontal position, the first sleeve is rotated on the hinge bar in said one direction;

the first sleeve further comprising a plurality of first annular engagement fingers on an end opposite said one end, the second sleeve mounted on the hinge bar adjacent to the first sleeve and comprising a plurality of second annular engagement fingers at one end thereof positioned for interlocking with the first engagement fingers, the first and second fingers shaped such that as the first sleeve rotates about the hinge bar, driven by the toothed sprocket, the second sleeve is caused to slide along the hinge bar in linear motion away from the first sleeve;

a flexible cable means interconnecting the second sleeve with the flow control means so that as the second sleeve is caused to move away from the first sleeve the cable means is caused to actuate the flow control means for flushing the toilet.

2. The toilet lid assembly of claim 1 wherein the hinge bar comprises an axial channel therethrough and an engagement slot, the cable means being conducted through the channel fixed at one end thereof to an anchor bar slidably fitted in the engagement slot, and fixed to the second sleeve for linear movement therewith.

* * * * *